US007282816B2

(12) United States Patent
Ridgeway

(10) Patent No.: US 7,282,816 B2
(45) Date of Patent: Oct. 16, 2007

(54) MANUAL SWITCH REMOTE CONTROLLER

(76) Inventor: Charles S. Ridgeway, 1627 Marquette Rd., Joliet, IL (US) 60435

( * ) Notice: Subject to any disclaimer, the term of this patent is extended or adjusted under 35 U.S.C. 154(b) by 568 days.

(21) Appl. No.: 10/836,717

(22) Filed: May 3, 2004

(65) Prior Publication Data

US 2005/0242244 A1 Nov. 3, 2005

(51) Int. Cl.

| | |
|---|---|
| ***B61L 5/00*** | (2006.01) |
| ***B61L 11/08*** | (2006.01) |
| ***H01H 19/14*** | (2006.01) |
| ***H02B 1/24*** | (2006.01) |

(52) U.S. Cl. ..... 307/115; 307/127; 246/220; 246/224; 246/253

(58) Field of Classification Search ..... 307/127, 307/115; 246/218, 220, 224, 253
See application file for complete search history.

(56) References Cited

U.S. PATENT DOCUMENTS 3,552,692 A * 1/1971 Horeczky ..... 246/63 C
5,504,405 A * 4/1996 Hager ..... 318/439
5,806,809 A * 9/1998 Danner ..... 246/220
6,484,974 B1 * 11/2002 Franke et al. ..... 246/476

* cited by examiner

*Primary Examiner*—Michael Sherry
*Assistant Examiner*—Michael Rutland-Wallis
(74) *Attorney, Agent, or Firm*—Davis Chin

(57) ABSTRACT

A manual switch remote controller is adapted for use with a power switch machine to electrically and selectively move switch points of a track switch between a normal position and a reverse position from a remote location in the field. In one preferred embodiment, the manual switch remote controller includes a first switch for selectively connecting and disconnecting a first source of DC operating power from first and second input terminals to first and second output terminals which are coupled to respective first and second input operating terminals of a biased-neutral controller. A second switch is used for selectively connecting and disconnecting a second source of DC controlling power from third and fourth input terminals to third and fourth output terminals which are coupled to respective third and fourth input control terminals of the biased-neutral controller. Third and fourth switches are used for selectively connecting the first source of DC operating power from the first and second input terminal, when momentarily actuated, to the third and fourth output terminals with first and second polarities so as to cause the biased-neutral controller to energize either the reverse or normal field winding of the DC motor in order to electrically and selectively move the switch points between the normal and reverse positions.

19 Claims, 5 Drawing Sheets

MANUAL SWITCH REMOTE CONTROLLER

BACKGROUND OF THE INVENTION

1. Field of the Invention

This invention relates generally to railway track switch control apparatus and more particularly, the present invention relates to a manual switch remote controller adapted for use with a power switch machine to electrically move switch points of a track switch between a first position and a second position from a remote location in the field.

2. Description of the Prior Art

As is generally known in the Railroad Industry, power (electric) switch machines are used for operating a throw bar so as to move the switch points of a track switch or "throw the switch" into either a normal position or a reverse position. Normally, the power switch machines are controlled and operated by a train dispatcher or control operator sitting at a control office having a control panel. The control office is generally located at a great distance from the remote locations of the power switch machines.

In order to permit movement of trains between main and secondary tracks, the train dispatcher will actuate suitable control buttons on the control panel upon which a miniature track diagram is provided. As a result, trains running on the secondary tracks are caused to move onto the main tracks and trains running on the main tracks are caused to move onto the secondary tracks as required for the establishment of a route that has been selected.

These power switch machines are required to be tested in accordance with an industry standard set by the Federal Railroad Administration. These tests are required to be completed monthly and quarterly by the railroad companies in order to ensure that the switch points of the track switches, which are being moved by the power switch machines, are within a certain tolerance for safe train operation. Unfortunately, at times these power switch machines fail to operate properly and Railroad Signal Maintenance Personnel are needed to be sent to the remote locations or sites where the machines have been installed in order to make repairs and/or perform tests.

Typically, a user, i.e., Railroad Signal Maintenance Personnel, must use a hand crank supplied by the manufacturer, which is inserted into the gear end near the motor of the power switch machine, to physically move the switch points of the track switch in order to make the required tests and/or make the needed adjustments. Since some of the switch points consist of a section of rail which is up to thirty-nine (39) feet in length and weigh a little more than 45 lbs/ft, this manual cranking has frequently lead to back and shoulder injuries to the user which has resulted in costly labor loss and loss of time within the Railroad Industry.

Accordingly, it would be desirable to provide a manual switch remote controller which allows a user to take control of a power switch machine, located at a remote location in the field, from a train dispatcher or control operator stationed in a control office. It would be also advantageous that the manual switch remote controller allow the user to electrically move the switch points or "throw the switch" between the normal and reverse positions without the use of a hand crank, just as if the train dispatcher was throwing the switch electrically from his location in the control office. It would still be expedient that the manual switch remote controller be made as an add-on feature for existing power switch machines so as to be suitably mountable and wired into the controlling circuits of the machines. As a result, there will be prevented injuries associated with the use of a hand crank to physically move the switch points of a track switch.

SUMMARY OF THE INVENTION

Accordingly, it is a general object of the present invention to provide a manual switch remote controller adapted for use with a power switch machine for electrically moving switch points of a track switch which is relatively simple construction and operation, but solves the problems encountered with prior art power switch machines.

It is an object of the present invention to provide a manual switch remote controller which allows a user to take control of a power switch machine, located at a remote location in the field, from a train dispatcher or control operator stationed in a control office.

It is another object of the present invention to provide a manual switch remote controller allow the user to electrically move the switch points or "throw the switch" between the normal and reverse positions without the use of a hand crank.

It is still another object of the present invention to provide a manual switch remote controller which can be made as an add-on feature for existing power switch machines so as to be suitably mountable and wired into the controlling circuits of the machines.

In a preferred embodiment of the present invention, there is provided a manual switch remote controller which is adapted for use with a power switch machine to electrically and selectively move switch points of a track switch between a normal position and a reverse position from a remote location in the field. The power switch machine includes a biased-neutral controller and a DC motor having normal and reverse field windings. The manual switch remote controller includes a first switch for selectively connecting and disconnecting a first source of DC operating power from first and second input terminals to first and second output terminals. The first and second output terminals are coupled to respective first and second input operating terminals of the biased-neutral controller. A second switch is used for selectively connecting and disconnecting a second source of DC controlling power from third and fourth input terminals to third and fourth output terminals. The third and fourth output terminals are coupled to respective third and fourth input control terminals of the biased-neutral controller.

A third switch is used for selectively connecting the first source of DC operating power from the first and second input terminals, when momentarily actuated, to the third and fourth output terminals with a first polarity so as to cause the biased-neutral controller to energize the reverse field winding of the DC motor in order to electrically and selectively move the switch points to the normal position. A fourth switch is used for selectively connecting the first source of DC operating power from said first and second input terminal, when momentarily actuated, to the third and fourth output terminals with a second and opposite polarity so as to cause the biased-neutral controller to energize the normal field winding of the DC motor in order to electrically and selectively move the switch points to the reverse position.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENTS

Figure 1:
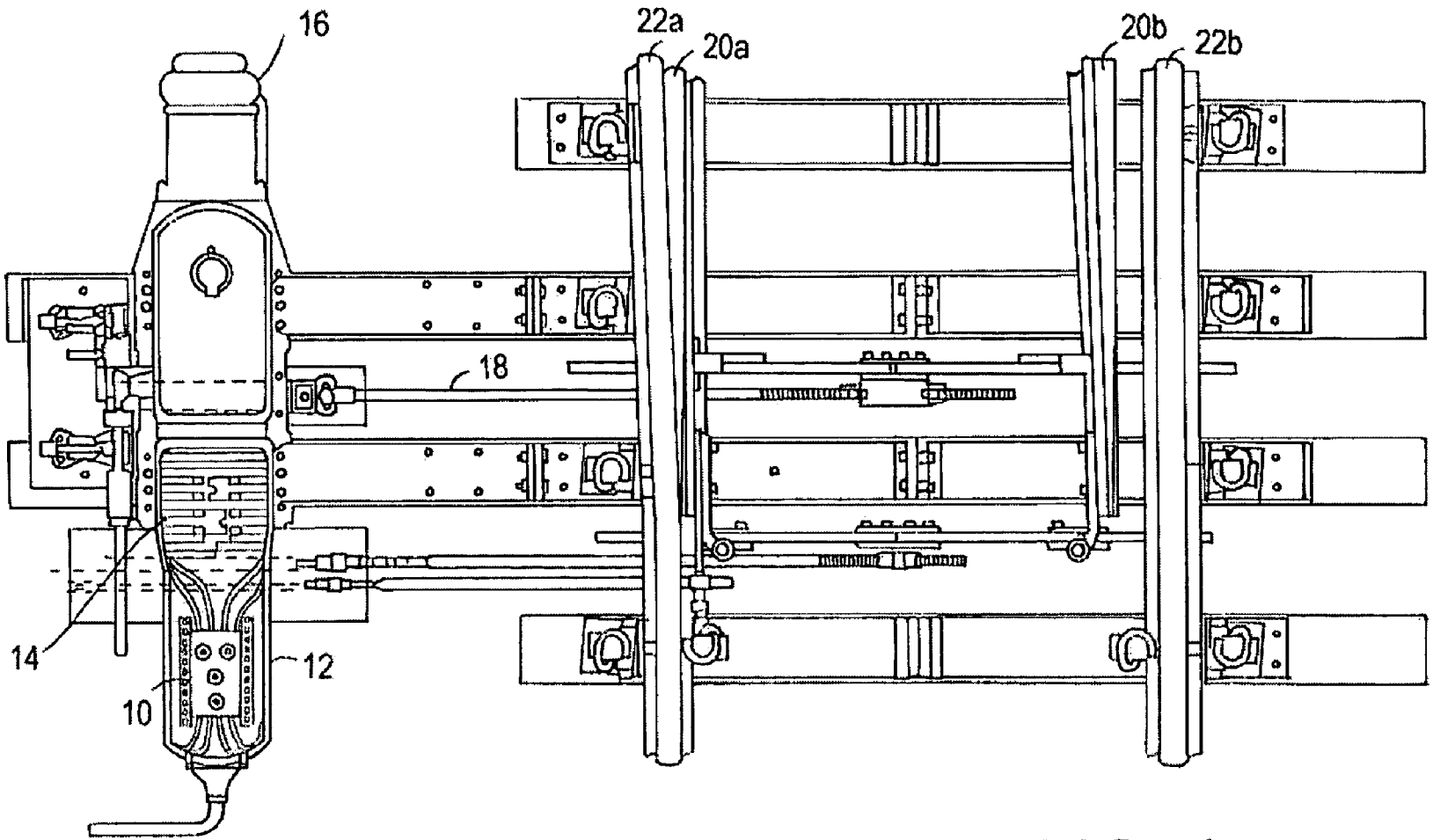
FIG. 1 is a top plan view of a manual switch remote controller, constructed in accordance with the principles of the present invention and illustrated in combination with a power switch machine.

It is to be distinctly understood at the outset that the present invention shown in the drawings and described in detail in conjunction with the preferred embodiments is not intended to serve as a limitation upon the scope or teachings thereof, but is to be considered merely as an exemplification of the principles of the present invention.

Referring now in detail to the drawings, there is illustrated in FIG. 1 a top plan view of a manual switch remote controller 10, constructed in accordance with the principles of the present invention, which has been installed as an add-on feature into controlling circuits of an existing a power switch machine 12. The present manual switch remote controller 10 is especially designed for suitable use with a power switch machine similar to the type which is manufactured and sold by Alstom Signaling Inc. of Rochester, N.Y., as their Models 5H, 5G and 5D.

For example, the controller 10 can also be used with other power switch machines which are commercially available from Union Switch and Signal Company, Safetran, and G. E. Harris. The manual switch remote controller allows railway personnel, such as railroad signal maintenance persons, to take control the operation of the power switch machine, located in the field, from a train dispatcher or control operator situated in a control office some distance away.

As previously pointed out, when it is required to perform periodic test and/or make repairs the maintenance person must travel to the remote site where the power switch machine 12 is located and then use a hand crank to physically move the switch points of a track switch. Due to the weight and length of the switch points, back and shoulder injuries have been suffered by the railroad personnel. The manual switch remote controller 10 serves to prevent these types of injuries to railroad personnel by allowing them to electrically move the switch points by simply pushing a switch, just like the train dispatcher would do from his control office location.

As can be seen, the power switch machine 12 includes a biased-neutral controller 14, a DC motor 16 having field windings and an armature, and a throw bar 18. The throw bar 18 is operatively connected to parallel movable tracks 20*a* and 20*b* which are disposed between parallel stationary tracks 22*a* and 22*b*. In normal operating conditions, operating energy (i.e., +110 or +24 VDC) for the motor 16 supplied from a central source controlled by the train dispatcher in the control office and is applied to the field windings thereof in response to control energy (i.e., +24 to +32 VDC). This control energy is also supplied from the central source and is applied to the biased-neutral controller 14.

When the movable tracks 20*a* and 20*b* are in the "normal" position as shown in FIG. 1, the movable track 20*a* is closed to be adjacent to the stationary track 22*a*, and the movable track 20*b* is opened to be spaced apart from the stationary track 22*b*. With the control energy applied to the biased-neutral controller with a first polarity, the operating energy will be applied to the reverse field winding of the DC motor 16 so as to cause the throw bar 18 to move the tracks 20*a* and 20*b* to the "reverse" position. In this "reverse" position, the track 20*a* will be opened to be spaced apart from the track 22*a*, and the track 20*b* will be closed to be adjacent to the track 22*b*. In this manner, the movable tracks (switch points) will be moved so as to cause a train traveling on a main track to be transferred to a secondary track.

In order to move the tracks 20*a* and 20*b* back to the "normal" position, the control energy is applied to the biased-neutral controller 14 with a second polarity (opposite to the first polarity). As a result, the operating energy will be applied to the normal field winding of the DC motor 16 so to cause the throw bar 18 to move the tracks 20*a* and 20*b* back to the "normal", as depicted in FIG. 1.

The manual switch remote controller 10 allows the user (maintenance person) to perform this same function just described on the power switch machine located in the field without the use of a hand crank in order to make and check adjustment, to perform testing and to make repairs or maintenance. The manual switch remote controller uses the existing operating energy already available within the power switch machine as the control energy in order to actuate the biased-neutral controller 14 and thus the DC motor 16 for electrically moving the switch points.

Figure 2:
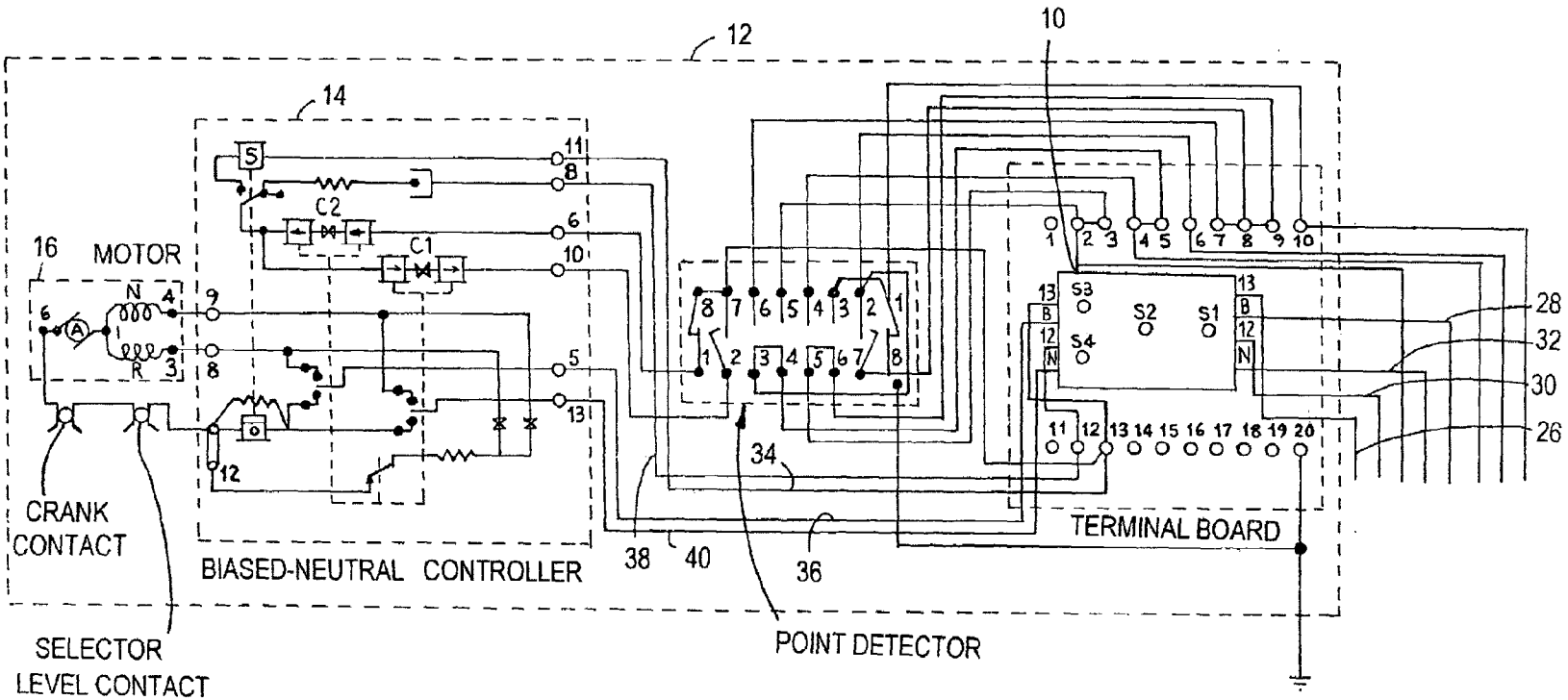
FIG. 2 is a schematic diagram, illustrating the wiring connections of the present manual switch remote controller in conjunction with the power switch machine of FIG. 1.
Figure 3:
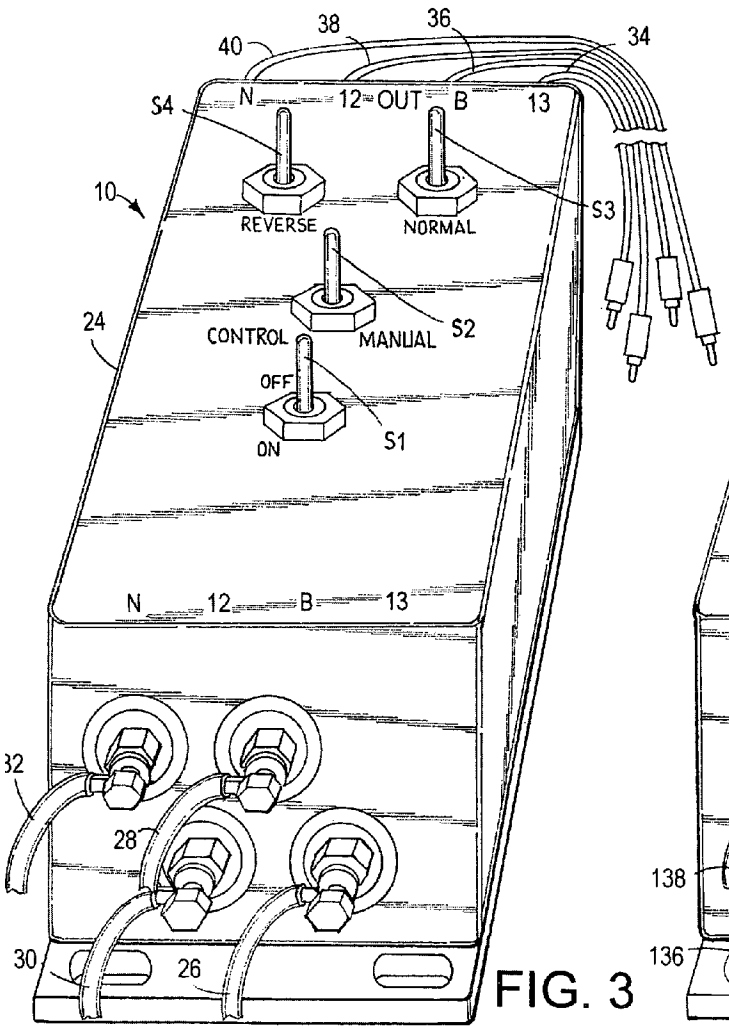
FIG. 3 is a front plan view of the manual switch remote controller of FIG. 1.

FIG. 2 is a schematic diagram which illustrates the wiring connections of the manual switch controller 10 between the outputs of controlling circuits (not shown) that normally actuates the power switch machine 12 when controlled by the train dispatcher and the inputs of the power switch machine. FIG. 3 is a front plan view of the manual switch controller 10 which has a body housing 24 of a rectangular shape and constructed of a suitable material, such as aluminum, plastic, phenolic, a Bakelite material, or the like.

A first end of the housing 24 is provided with four input cables 26, 28, 30 and 32. The first input cable 26 is connected to an input terminal 13, and the second input cable 28 is connected to an input terminal B. The third input cable 30 is connected to an input terminal 12, and the fourth input cable 32 is connected to an input terminal N. The input terminals B and N are connectable to a source of operating energy or power from the outputs of the controlling circuits. This operating power may be a +110 V or +24 V battery having a positive (+) terminal connected the input terminal B and a negative (−) terminal connected to the input terminal N. The input terminals 12 and 13 are connected to receive a source of control energy or power from also the outputs of the controlling circuits. This control energy may be in the range of +24 VDC to +32 VDC which is selectively applied so that its positive terminal can be connected to either the input terminal 13 (first polarity) or the input terminal 12 (second or opposite polarity) and its negative terminal connected to the other input terminal 12 or 13.

The second end of the housing 24 is provided with four output cables 34, 36, 38 and 40. The first output cable 34 is connected to an output terminal 13, and the second output cable 36 is connected to an output terminal B. The third output cable 38 is connected to an output terminal 12, and the fourth output cable 40 is connected to an output terminal N. The output terminal 13 is coupled to input control terminal 11 of the biased-neutral controller 14, and the output terminal 12 is coupled to input control terminal 8 thereof. The output terminals B and N are connected to respective input operating terminals 5 and 13 of the controller 14.

The top surface of the housing 24 has mounted therein four switches S1, S2, S3 and S4. The first switch S1 is a power "ON/OFF" switch which is used to selectively connect and disconnect the operating energy (+110 or +24 VDC) to the power switch machine 12. When it is set to the "OFF" position, the operating energy is disconnected from the power switch machine. In the "ON" position, the operating energy is allowed to be connected to the output terminals B and N and thus to the input operating terminals of the biased-neutral controller 14 via the respective output cables 36 and 40. The second switch S2 is a "CONTROL/MANUAL" switch which is used to selectively connect and disconnect the control energy (+24 VDC to +32 VDC) to the power switch machine 12. When it is set to the "CONTROL" position, the control energy is allowed to be connected to the output terminals 13 and 12 and thus to the input control terminals 11 and 8 of the controller 12 via the respective output cables 34 and 38. When it is in the "MANUAL" position, the control energy is disconnected from the output terminals 13 and 12.

The switch S3 is a "NORMAL" switch which is used to selectively connect the operating energy on the input terminals B and N, when momentarily actuated, to the output terminal 13 and 12 and to the input control terminals 11 and 8 of the controller 14 via the respective output cables 34 and 38 with the first polarity. This will cause the controller 14 to energize the reverse field winding of the DC motor 16 with the operating energy so as to electrically move the switch points from the "reverse" position to the "normal" position of FIG. 1.

The switch S4 is a "REVERSE" switch which is used to selectively connect the operating energy on the input terminals B and N, when momentarily actuated, to the output terminal 13 and 12 and to the input control terminals 11 and 8 of the controller 14 via the respective output cables 34 and 38 with the opposite polarity. This will cause the controller 14 to energize the normal field winding of the DC motor 16 with the operating energy so as to electrically move the switch points from the "normal" position to the "reverse" position.

Figure 4:
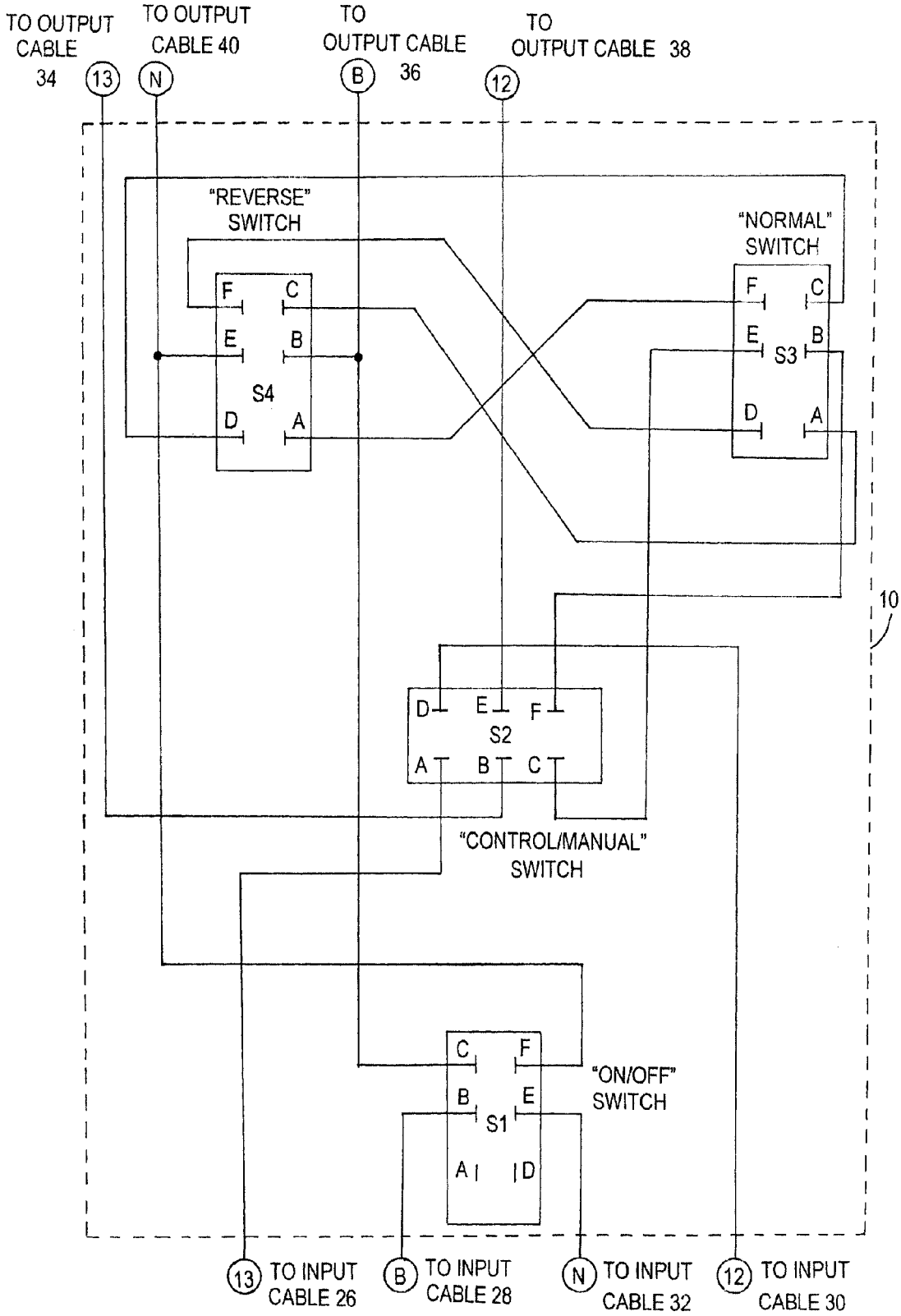
FIG. 4 is a detailed schematic circuit diagram of the present manual switch remote controller of FIG. 3.

In FIG. 4, there is shown a detailed schematic circuit diagram of the manual switch remote controller 10 of the present invention where the switches S1 through S4 are interconnected to perform the functions just described above. Each of the switches S1, S2 is a double-pole, double-throw (DPDT) toggle switch which is similar to the type commercially available from Sierra Materials Company under their Part No. S3960BA. Each of the switches S3, S4 is a double-pole, double-throw (DPDT) momentarily toggle switch which is similar to the type commercially available from Sierra Materials Company under their Part No. S3965BA.

In normal operation, the switch S1 will be in the "ON" position and the switch S2 will be in the "CONTROL" position. Since the contacts b-c and e-f of the switch S1 are closed, the operating energy applied on the input terminals B and N from the respective input cables 28 and 32 are passed through to the respective output terminals B and N. Further, since the contacts b-c and e-f of the switch S2 are also closed, the control energy applied on the input terminals 13 and 12 from the respective input cables 26 and 30 are passed through to the respective output terminals 13 and 12. When the user (maintenance person) has need to perform tests and/or make repairs on the power switch machine 12, he will initially obtain clearance from the train dispatcher before taking over the control of the machine 12.

Thereafter, the user will set the switch S1 on the manual switch remote controller 10 to the "OFF" position. This will open the contacts b-c and e-f, thereby disconnecting the operating power to the machine 12. The user can now proceed to setting up any of the equipment he needs for testing and making calibrations in order to check out the machine 12. After he completes the set-up, he will then move the switch S2 to the "MANUAL" position. This will open the contacts a-b and d-e so as to disconnect the control energy and close the contacts b-c and e-f. Next, he will move the switch S1 back to the "ON" position, thereby restoring the operating energy to the machine.

Assuming that the movable tracks 20*a*, 20*b* are in the "reverse" position, the "NORMAL" switch S3 will be actuated or toggled upwardly and held there until the switch points are moved all the way back to the "normal" position of FIG. 1, thereby allowing the power switch machine 12 to complete its throw. On the other hand, the switch S3 can be toggled momentarily so as to move the switch points to a desired location dependent upon the length of time it toggled upwardly. The DC motor 16 will stop automatically when the throw is completed or when the switch S3 is released.

With the switch S3 being held upwardly, the input terminal B will be connected through the closed contacts b-c of switch S1, closed contacts a-b of switch S4, closed contacts e-f of switch S3, closed contacts b-c of switch S2 to the output terminal 13. Similarly, the input terminal N will be connected through the closed contacts e-f of switch S1, closed contacts d-e of switch S4, closed contacts b-c of switch S3, closed contacts e-f of switch S2 to the output terminal 12. As a result, this operating energy will be connected to the input control terminals 11 and 8 of the controller 14 with a positive polarity via the output cables 34 and 38. The contactors C2 and C1 of the controller 14 will, in turn, cause the operating energy on the input operating terminals 5 and 13 to be applied to the reverse field winding R of the DC motor 16, thereby moving the switch points to the "normal" position of FIG. 1.

Assuming now that the movable tracks 20*a*, 20*b* are in the "normal" position, the "REVERSE" switch S4 will be actuated or toggled upwardly and held there until the switch points are moved all the way to the "reverse" position, thereby allowing the power switch machine 12 to complete its throw. On the other hand, the switch S4 can be toggled momentarily so as to move the switch points to a desired location dependent upon the length of time it toggled upwardly. The DC motor 16 will stop automatically when the throw is completed or when the switch S4 is released.

With the switch S4 being held upwardly, the input terminal B will be connected through the closed contacts b-c of switch S1, closed contacts b-c of switch S4, closed contacts a-b of switch S3, closed contacts e-f of switch S2 to the output terminal 12. Similarly, the input terminal N will be connected through the closed contacts e-f of switch S1, closed contacts e-f of switch S4, closed contacts d-e of switch S3, closed contacts b-c of switch S2 to the output terminal 13. As a result, this operating energy will be connected to the input control terminals 11 and 8 of the controller 14 with a negative polarity via the output cables 34 and 38. The contactors C2 and C1 of the controller 14 will, in turn, cause the operating energy on the input operating terminals 5 and 13 to be applied to the normal field winding N of the DC motor 16, thereby moving the switch points to the "reverse" position.

In the event that both of the switches S3 and S4 are accidentally toggled simultaneously, nothing will be happen since the operating energy will not be applied to the control terminals of the controller 14. As a consequence, no movement will occur with the motor 16 in the power switch machine 12, thereby making the operation of the present manual switch remote controller 10 failsafe. After the user has completed all of the proper checking, testing, and repairs to the power switch machine, the switch S2 will be moved back to the "CONTROL" position and he will contact the dispatcher to inform him that control of the machine has been given back to him.

Figure 5:
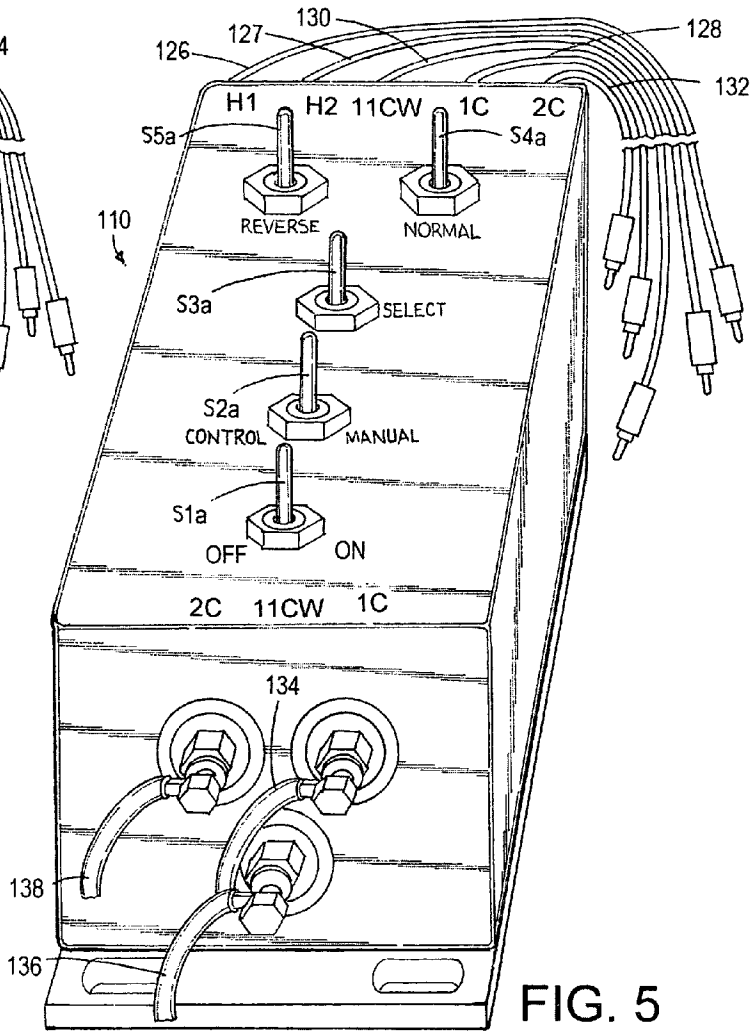
FIG. 5 is a top plan view of a second embodiment of a manual switch remote controller in accordance with the present invention.

In FIG. 5, there is illustrated a front plan view of a second embodiment of manual switch remote controller 110 of the present invention. The present manual switch remote controller 110 is especially designed for suitable use with a power switch machine similar to the type which is manufactured and sold by Alstom Signaling Inc. of Rochester, N.Y., as their Model 5F. The Model 5F switch machine is substantially the same as the Model 5H machine, except that it does not have a biased-neutral controller. The manual switch remote controller 110 is substantially identical in its construction as the controller 10. In particular, the manual switch controller 110 has a body housing 124 of a rectangular shape and constructed of a suitable material, such as aluminum, plastic, phenolic, a Bakelite material, or the like.

A first end of the housing 124 is provided with five input cables 126, 127, 128, 130 and 132. The first input cable 126 is connected to an input terminal H1, and the second input cable 127 is connected to an input terminal H2. The third input cable 128 is connected to an input terminal 1C, the fourth input cable 130 is connected to an input terminal 11CW, and the fifth input cable 132 is connected to an input terminal 2C. The input terminals H1 and H2 are connectable to a source of operating energy or power from the outputs of the controlling circuits (not shown) that normally actuate the power switch machine. Instead of a DC power source, this operating power is an AC power source whose outputs are coupled across the input terminals H1 and H2 via the input cables 126 and 127. The input terminals 1C, 11Cw and 2C are connected to receive a source of operating energy or power from also the outputs of the controlling circuits. This operating energy may be in the range of +24 VDC to +32 VDC which is selectively applied so that its positive terminal can be connected to either the input terminal 1C (first polarity) or the input terminal 11CW (second or opposite polarity) and its negative terminal connected to the input terminal 11CW or 2C.

The second end of the housing 124 is provided with three output cables 134, 136, and 138. The first output cable 134 is connected to an output terminal 1C, and the second output cable 136 is connected to an output terminal 11CW. The third output cable 138 is connected to an output terminal 2C. The output terminal 1C is coupled to the reverse field winding R of the DC motor, and the output terminal 2C is coupled to the normal field winding N of the DC motor. The output terminal 11CW is connected to a common armature terminal of the DC motor.

The top surface of the housing 224 has mounted therein five switches S1*a*, S2*a*, S3*a*, S4*a*, S5*a*. The first switch S1*a* is a power "ON/OFF" switch which is used to selectively connect and disconnect the operating energy (110 AC) to the controller 110. When it is set to the "OFF" position, the operating energy is disconnected from the controller. In the "ON" position, the operating energy is connected to the input terminals of a full wave bridge rectifier via the respective input cables 126 and 127. The second switch S2*a* is a "CONTROL/MANUAL" switch which is used to selectively connect and disconnect the operating energy (+24 VDC to +32 VDC) to the power switch machine 12. When it is set to the "CONTROL" position, the operating energy is allowed to be connected to the output terminals 1C, 11CW and 2C and thus to the input terminals of the DC motor via the respective output cables 134 through 138. When it is in the "MANUAL" position, the operating energy is disconnected from the output terminals 1C, 11CW and 2*c*.

The switch S4*a* is a "NORMAL" switch which is used to selectively connect the operating energy on the output terminals (+) and (−) of the bridge rectifier BR, when momentarily actuated, to the output terminal 1C and 11CW with a first polarity and to the input operating terminals of the motor via the respective output cables 134 and 136. This will cause current to flow through the reverse field winding R of the DC motor so as to electrically move the switch points from the "reverse" position to the "normal" position of FIG. 1.

The switch S5*a* is a "REVERSE" switch which is used to selectively connect the operating energy on the output terminals (+) and (−) of the bridge rectifier BR, when momentarily actuated, to the output terminal 11CW and 2C with the opposite polarity and to the input operating terminals of the motor via the respective output cables 136 and 138. This will cause current to flow through the normal field winding N of the DC motor so as to electrically move the switch points from the "normal" position to the "reverse" position.

The S3*a* is a "SELECT" safety switch which is used to permit only actuation of either the "NORMAL" switch S4*a* or the "REVERSE" switch S5*a* at one time so as to prevent damage to the motor. When the switch S3*a* is in the right position, only the "REVERSE" switch S5*a* is allowed to be operated. When the switch S3*a* is in the left position, only the "NORMAL" switch S4*a* is allowed to be operated. In the center position, neither of the switches S4*a* or S5*a* is operable.

Figure 6:
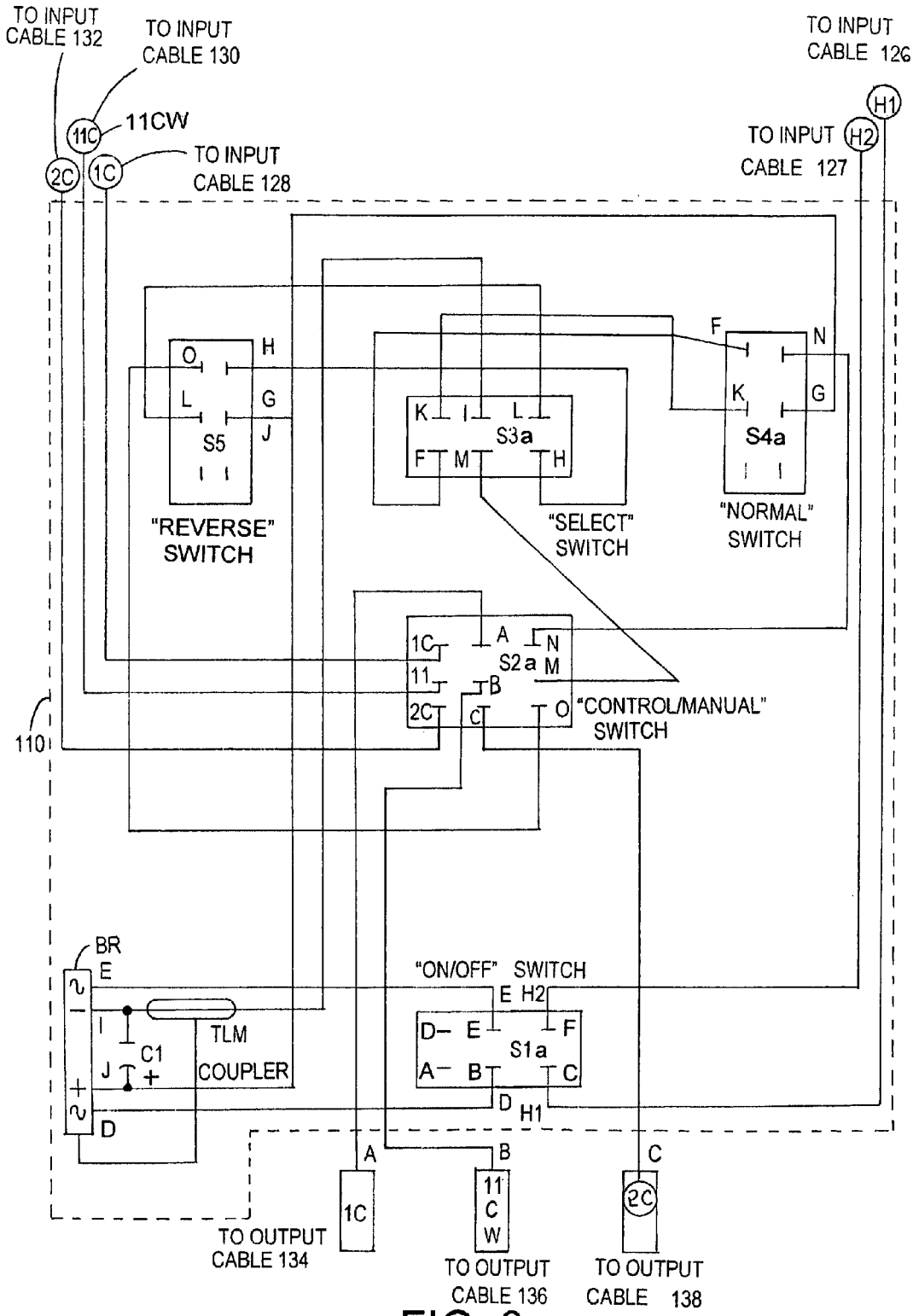
FIG. 6 is a detailed schematic circuit diagram of the present manual switch remote controller of FIG. 5.

In FIG. 6, there is shown a detailed schematic circuit diagram of the manual switch remote controller 110 of the present invention where the switches S1*a* through S5*a* are interconnected to perform the functions just described above. Each of the switches S1*a*, S2*a* is a double-pole, double-throw (DPDT) toggle switch which is similar to the type commercially available from Sierra Materials Company under their Part No. S3960BA. Each of the switches S4*a*, S5*a* is a double-pole, double-throw (DPDT) momentarily toggle switch which is similar to the type commercially available from Sierra Materials Company under their Part No. S3965BA. The switch S3*a* is a triple-pole, double-throw toggle switch which is similar to the type commercially available from Sierra Material Company under their Part No. S3961BA.

From the foregoing detailed description, it can thus be seen that the present invention provides a manual switch remote controller adapted for use with a power switch machine to electrically and selectively move switch points of a track switch between a normal position and a reverse position. As a result, there is prevented shoulder and back injuries associated with the use of a hand crank to physical move the switch points of the track switch.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

The invention claimed is:

1. A manual switch remote controller adapted for use onto a power switch machine which allows a user to take control of the power switch machine, located at a remote location in the field, from a train dispatcher stationed in a control office located at a great distance from the remote location of the power switch machine to electrically and selectively move switch points of a track switch between a normal position and a reverse position, said power switch machine including a biased-neutral controller and a DC motor having normal and reverse field windings, said manual switch remote controller comprising:

a housing having input cables connected to receive a first source of DC operating power on first and second input terminals of said manual switch remote controller and connected to receive a second source of DC controlling power on third and fourth input terminals of said manual switch remote controller;

said housing having output cables connected to first and second output terminals of said manual switch remote controller and connected to third and fourth output terminals of said manual switch remote controller;

said housing being mounted and connected directly to said power switch machine located at the remote location;

first switch means disposed in said housing for selectively connecting and disconnecting the first source of DC operating power via said input cables from the first and second input terminals of said manual switch remote controller to the first and second output terminals of said manual switch remote controller;

said first and second output terminals of said manual switch remote controller being coupled via said output cables to respective first and second input operating terminals of said biased-neutral controller;

second switch means disposed in said housing for selectively connecting and disconnecting the second source of DC controlling power via said input cables from the third and fourth input terminals of said manual switch remote controller to the third and fourth output terminals of said manual switch remote controller;

said third and fourth output terminals of said manual switch remote controller being coupled via said output cables to respective third and fourth input control terminals of said biased-neutral controller;

third switch means disposed within said housing for selectively connecting the first source of DC operating power from said first and second input terminals of said manual switch remote controller, when momentarily actuated, to said third and fourth output terminals of said manual switch remote controller with a first polarity so as to cause said biased-neutral controller to energize the reverse field winding of the DC motor in order to electrically and selectively move the switch points to any desired location from the normal position and all the way back to the normal position dependent upon the length of actuation time; and fourth switch means disposed within said housing for selectively connecting the first source of DC operating power from said first and second input terminals of said manual switch remote controller, when momentarily actuated, to said third and fourth output terminals of said manual switch remote controller with a second and opposite polarity so as to cause said biased-neutral controller to energize the normal field winding of the DC motor in order to electrically and selectively move the switch points to any desired location from the reverse position and all the way back to the reverse position dependent upon the length of actuation time.

2. A manual switch remote controller as claimed in claim 1, wherein said first switch means is a power "ON/OFF" switch of a double-pole, double-throw type.

3. A manual switch remote controller as claimed in claim 2, wherein said second switch means is a "CONTROL/MANUAL" switch of a double-pole, double-throw type.

4. A manual switch remote controller as claimed in claim 3, wherein said third switch means is a "NORMAL" switch of a momentarily double-pole, double-throw type.

5. A manual switch remote controller as claimed in claim 4, wherein said fourth switch means is a "REVERSE" switch of a momentarily double-pole, double-throw type.

6. A manual switch remote controller as claimed in claim 5, wherein said when said first switch is in the "ON" position and said second switch is in the "CONTROL" position, the power switch machine is controlled by a train dispatcher from a control office.

7. A manual switch remote controller as claimed in claim 5, wherein said when said first switch is in the "ON" position and said second switch is in the "MANUAL" position, the power switch machine is controlled by a maintenance person at the remote location in the field by selectively actuating one of said third and fourth switches.

8. A manual switch remote controller as claimed in claim 1, wherein said first source of DC operating power is a +110 VDC or +24 VDC.

9. A manual switch remote controller as claimed in claim 8, wherein said second source of DC controlling power is in the range of +24 VDC to +32 VDC.

10. A manual switch remote controller adapted for use onto a power switch machine which allows a user to take control of the power switch machine, located at a remote location in the field, from a train dispatcher stationed in a control office located at a great distance from the remote location of the power switch machine to electrically and selectively move switch points of a track switch between a normal position and a reverse position, said power switch machine including a DC motor having normal and reverse field windings, said manual switch remote controller comprising:

a housing having input cables connected to receive a first source of AC operating power on first and second input terminals of said manual switch remote controller and connected to receive a second source of DC operating power on third, fourth and fifth input terminals of said manual switch remote controller;

said housing having output cables connected to first, second and third output terminals of said manual switch remote controller;

said housing being mounted and connected directly to said power switch machine located at the remote location;

first switch means disposed in said housing for selectively connecting and disconnecting the source of AC operating power via said input cables from the first and second input terminals of said manual switch remote controller;

rectifier means responsive to said source of AC operating power through said first switch means for generating a first source of DC operating power;

second switch means disposed in said housing for selectively connecting and disconnecting the second source of DC operating power from the third, fourth and fifth input terminals of said manual switch remote controller to the first, second and third output terminals of said manual switch remote controller;

said first through third output terminals of said manual switch remote controller being coupled to respective first through third input operating terminals of said DC motor;

third switch means disposed in said housing for selectively controlling the operation of fourth and fifth switch means;

said fourth switch means disposed in said housing and being responsive to said third switch means for selectively connecting the first source of DC operating power, when momentarily actuated, to said first and second output terminals of said manual switch remote controller with a first polarity so as to energize the reverse field winding of the DC motor in order to electrically and selectively move the switch points to any desired position from the normal position and all the way back to the normal position dependent upon the length of actuation time; and said fifth switch means disposed in said housing and being responsive to said third switch means for selectively connecting the first source of DC operating power, when momentarily actuated, to said third and second output terminals of said manual switch remote controller with a second and opposite polarity so as to energize the normal field winding of the DC motor in order to electrically and selectively move the switch points to any desired position from the reverse position and all the way back to the reverse position dependent upon the length of actuation time.

11. A manual switch remote controller as claimed in claim 10, wherein said first switch means is a power "ON/OFF" switch of a double-pole, double-throw type.

12. A manual switch remote controller as claimed in claim 11, wherein said second switch means is a power "CONTROL/MANUAL" switch of a double-pole, double-throw type.

13. A manual switch remote controller as claimed in claim 12, wherein said third switch means is a "SELECT" switch of a triple-pole, double-throw type.

14. A manual switch remote controller as claimed in claim 13, wherein said fourth switch means is a "NORMAL" switch of a momentarily double-pole, double-throw type.

15. A manual switch remote controller as claimed in claim 14, wherein said fifth switch means is a "REVERSE" switch of a momentarily double-pole, double-throw type.

16. A manual switch remote controller as claimed in claim 15, wherein said when said first switch is in the "ON" position and said second switch is in the "CONTROL" position, the power switch machine is controlled by a train dispatcher from a control office.

17. A manual switch remote controller as claimed in claim 15, wherein said when said first switch is in the "ON" position and said second switch is in the "MANUAL" position, the power switch machine is controlled by a maintenance person at the remote location in the field by selectively actuating one of said fourth and fifth switches.

18. A manual switch remote controller as claimed in claim 10, wherein said first source of AC operating power is a 110 VAC.

19. A method for remotely controlling a power switch machine to electrically and selectively move switch points of a track switch between a normal position and a reverse position from a remote location in the field, said power switch machine including a biased-neutral controller and a DC motor having normal and reverse field windings, said method comprising the steps of:

mounting and connecting a manual switch remote controller housing directly to the power switch machine located at a remote location;

selectively connecting and disconnecting through a first switch disposed in the manual switch remote controller housing a first source of DC operating power from first and second input terminals of the manual switch remote controller housing to first and second output terminals of the manual switch remote controller housing;

coupling the first and second output terminals of the manual switch remote controller housing to respective first and second input operating terminals of the biased-neutral controller;

selectively connecting and disconnecting through a second switch disposed in the manual switch remote controller housing a second source of DC controlling power from third and fourth input terminals of the manual switch remote controller housing to third and fourth output terminals of the manual switch remote controller housing;

coupling the third and fourth output terminals of the manual switch remote controller housing to respective third and fourth input control terminals of the biased-neutral controller;

selectively connecting the first source of DC operating power through a third switch disposed in the manual switch remote controller housing from the first and second input terminals of the manual switch remote controller housing, when momentarily actuated, to the third and fourth output terminals of the manual switch remote controller housing with a first polarity so as to cause the biased-neutral controller to energize the reverse field winding of the DC motor in order to electrically and selectively move the switch points to any desired location from the normal position and all the way back to the normal position dependent upon the length of actuation time; and selectively connecting the first source of DC operating power through a fourth switch disposed in the manual switch remote controller housing from said first and second input terminals of the manual switch remote controller housing, when momentarily actuated, to the third and fourth output terminals with a second and opposite polarity so as to cause the biased-neutral controller to energize the normal field winding of the DC motor in order to electrically and selectively move the switch points to any desired location from the reverse position and all the way back to the reverse position dependent upon the length of actuation time.

* * * * *